US007851982B2

(12) United States Patent
Kessels et al.

(10) Patent No.: US 7,851,982 B2
(45) Date of Patent: Dec. 14, 2010

(54) LAMP

(75) Inventors: Henricus Mathias Marie Kessels, Eindhoven (NL); Richard Franciscus Joseph Feller, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 234 days.

(21) Appl. No.: 11/575,583

(22) PCT Filed: Aug. 18, 2005

(86) PCT No.: PCT/IB2005/052726

§ 371 (c)(1),
(2), (4) Date: Mar. 20, 2007

(87) PCT Pub. No.: WO2006/035324

PCT Pub. Date: Apr. 6, 2006

(65) Prior Publication Data

US 2008/0079345 A1 Apr. 3, 2008

(30) Foreign Application Priority Data

Sep. 27, 2004 (EP) ..... 04104684

(51) Int. Cl.
*H01J 31/60* (2006.01)
*H01J 31/00* (2006.01)

(52) U.S. Cl. ..... 313/25; 313/17; 445/23

(58) Field of Classification Search ..... 313/634, 313/25, 17, 50, 146, 148, 317, 318.02, 318.05, 313/318.1, 318.09, 356
See application file for complete search history.

(56) References Cited

U.S. PATENT DOCUMENTS

| | | | | |
|---|---|---|---|---|
| 5,136,204 | A * | 8/1992 | Muzeroll et al. | 313/25 |
| 5,670,840 | A | 9/1997 | Lanese et al. | |
| 6,153,968 | A * | 11/2000 | Dombrowski et al. | 313/238 |
| 6,329,742 | B1 * | 12/2001 | Nelson et al. | 313/25 |
| 6,741,034 | B2 * | 5/2004 | Scholz | 313/623 |

FOREIGN PATENT DOCUMENTS

| | | | |
|---|---|---|---|
| EP | 1391914 | A2 * | 2/2004 |
| EP | 1403905 | A2 * | 3/2004 |
| GB | 260756 | A | 11/1926 |
| GB | 737913 | A | 10/1955 |
| WO | 0011704 | A1 | 3/2000 |
| WO | 0075958 | A1 | 12/2000 |

* cited by examiner

*Primary Examiner*—Bumsuk Won
*Assistant Examiner*—Nathaniel J Lee

(57) ABSTRACT

The invention relates to a lamp having a light source (10) and a sub-assembly comprising a protective sleeve (1) and two frame members, wherein the two frame members (2, 3) are each supporting the sleeve. Each frame member may comprise a clamping spring, which serves as a connection between the frame member and the sleeve. The invention also relates particularly to a lamp with an outer vessel (45), which is a parabolic aluminized reflector, and a light source, which is a ceramic discharge metal halide burner.

8 Claims, 5 Drawing Sheets

LAMP

The invention relates to a lamp having a light source and a sub-assembly comprising a protective sleeve and two frame members. Such a sub-assembly is typically used around a light source that may be subject to the risk of explosion. An explosion can occur both when the light source comprises a pair of electrodes and when it comprises a filament. Protective sleeves of quartz or other transparent materials, which are able to withstand lamp-operating temperatures, are commonly applied around a light source to provide protection against non-passive failure, like an explosion, during lamp operation. These sleeves act to slow down or stop fast moving fragments and prevent rupture of the outer envelope of the lamp. They may also provide other functions including, but not limited to, reduction of the UV output of the lamp.

The invention also relates particularly to a lamp comprising a ceramic discharge metal halide (CDM) burner as a light source.

A lamp having a protective sleeve of quartz surrounding a metal halide arc tube comprising a pair of opposite leads is known from WO 00/75958. The sleeve is supported by a metal frame comprising a pair of frame members which also supply current to the leads. Seven welds have to be made for the manufacture of the sub-assembly including the light source.

WO 00/11704 discloses a lamp with a glass envelope and an arrangement wherein a pair of frame members extend up from a stem and through the inside of the sleeve. These frame members are bent so that they are slightly further apart than the inner diameter of the sleeve and their spring tension holds the sleeve. The manufacture of the sub-assembly requires five welds. One frame member is provided with an integrally formed loop, which fits around a dimple formed in the upper axial end of the glass envelope to keep this frame member positioned. The lower ends of both frame members are fixed by a stem, which is sealed in the glass envelope.

EP 1 403 905 discloses a lamp with an envelope having a sub-assembly comprising a light source, which is mounted into a frame, the frame being attached to a mount in the lamp envelope. Alternatively, a sub-assembly of sleeve and arc tube can be mounted to the frame, thus requiring at least four welds.

EP 1 391 914 describes a similar principle in which an assembly, comprising a light source in a sleeve, is attached to a frame. The frame is formed by the electric lead-ins of the lamp. An arrangement of this type requires at least four welds.

The known designs have the drawback that they require a long assembly time due to the large number of welds to be made and that they are insufficiently rigid, with an increased risk of their falling apart due to rough handling or transportation.

It is therefore an object of the invention to ensure that a lamp with a sub-assembly, and in particular a lamp with a ceramic metal halide arc tube, has a great strength and stiffness.

It is a further object of the invention to provide a lamp having a sub-assembly that can be made with fewer welded connections.

It is another object of the invention to provide a lamp comprising a protective sleeve around an accurately positioned light source.

According to the invention, the two frame members are each supporting the sleeve.

The strength and stiffness of the sub-assembly of the invention comprising the sleeve and the two frame members is derived from the sleeve, which typically consists of quartz or another hard transparent material which is able to withstand lamp-operating temperatures. This results in a sub-assembly with a greater stiffness and strength than the known sub-assemblies, and with no welded connections. The frame members preferably comprise a clamping spring, which serves as a connection between the frame member and the sleeve.

Each frame member preferably has support means that form a connection with the upper and lower end of the sleeve at both the inner and outer surface of said sleeve. The upper-end inner and outer support means may jointly form the clamping spring, by which the frame member is mounted to the sleeve. The clamping spring is designed in such a way that the sleeve is not only pressed against the upper outer support, but is also pushed into the lower inner support, thus providing a fixation of the sleeve in two mutually perpendicular directions. The sub-assembly according to the invention can thus be composed without any welded connection.

The invention also relates to a lamp comprising an outer vessel enclosing the sub-assembly of the invention, and a light source. A lamp, in which the sub-assembly can be applied, may be, for example, a flood lamp having a parabolic aluminized reflector (PAR), or a high-pressure discharge lamp which includes a structure for preventing failure of the outer envelope in the event of explosive rupture of the discharge vessel.

While the invention is particularly applicable to lamps having an arc or discharge tube as the light source, more particularly a CDM burner, it is also applicable to lamps having incandescent light sources such as the IR coated tungsten-halogen lamp disclosed in U.S. Pat. No. 5,670,840.

The frame members can be mounted to a base of the lamp by means of respective support members, situated at the lower part of a frame member. The relative position of the two frame members is not critical, on the understanding that their mutual distance is sufficient to provide the insulation for the high voltage when the lamp is started. In view of their connection to a base part of the lamp, the two frame members will be preferably on opposite sides of a line through the center of the sleeve. The strong and stiff arrangement thus obtained better meets the mechanical requirements of a PAR CDM lamp.

The light source can be mounted between an upper and a lower finger, both being a part of a respective frame member. The only welded connections to be made are then those for mounting the light source between the upper and the lower finger. With no other welded connections, this can be done in a more accurate way than in the existing arrangements. The two frame members preferably accomplish the function of current supply conductors.

The smaller number of components and welds in the lamp of the invention leads to a smaller risk of failure during assembly in production, a shorter assembly time, a better performance in terms of lifetime and lower component costs.

Assembly can be done, for example, by clamping two frame members opposite to each other on a sleeve and introducing the sub-assembly into a mold, after which a light source is positioned in the center of the sleeve and welded to the fingers of the frame members. The sub-assembly, possibly also provided with a getter welded to one of the frame members, may then be mounted to the base of the lamp.

The light source in the lamp of the invention may be a filament, a ceramic discharge vessel or a quartz high-pressure discharge vessel. The light source is preferably a ceramic discharge vessel. A ceramic discharge vessel may be tube-shaped or barrel-shaped and can be produced via known techniques, for instance, slip-casting. The closing construction may be a plug, which is co-sintered with the vessel, or the closing construction and vessel may be part of one slip-cast body.

In this application, "ceramic" is understood to mean a refractory material such as a mono-crystalline metal oxide (e.g. sapphire), a polycrystalline metal oxide (e.g. polycrystalline densely sintered aluminum oxide and YAG), and a polycrystalline non-oxide material (e.g. aluminum nitride). Such materials allow wall temperatures of 1500-1700 K and resist chemical attacks by halides and Na. For purposes of the present invention, polycrystalline aluminum oxide (PCA) has been found to be most suitable.

An additional protection against explosion is obtained in a lamp in which the glass cylindrical sleeve is a double-walled sleeve in that two separated concentric glass tubes are used. In this case, the lower-end support means are designed to support two sleeves, whereas the upper-end outer support means support the outer glass tube and the upper-end inner support means support the inner glass tube.

These and other aspects of the invention are apparent from and will be elucidated with reference to the embodiments described hereinafter.

Figure 1:
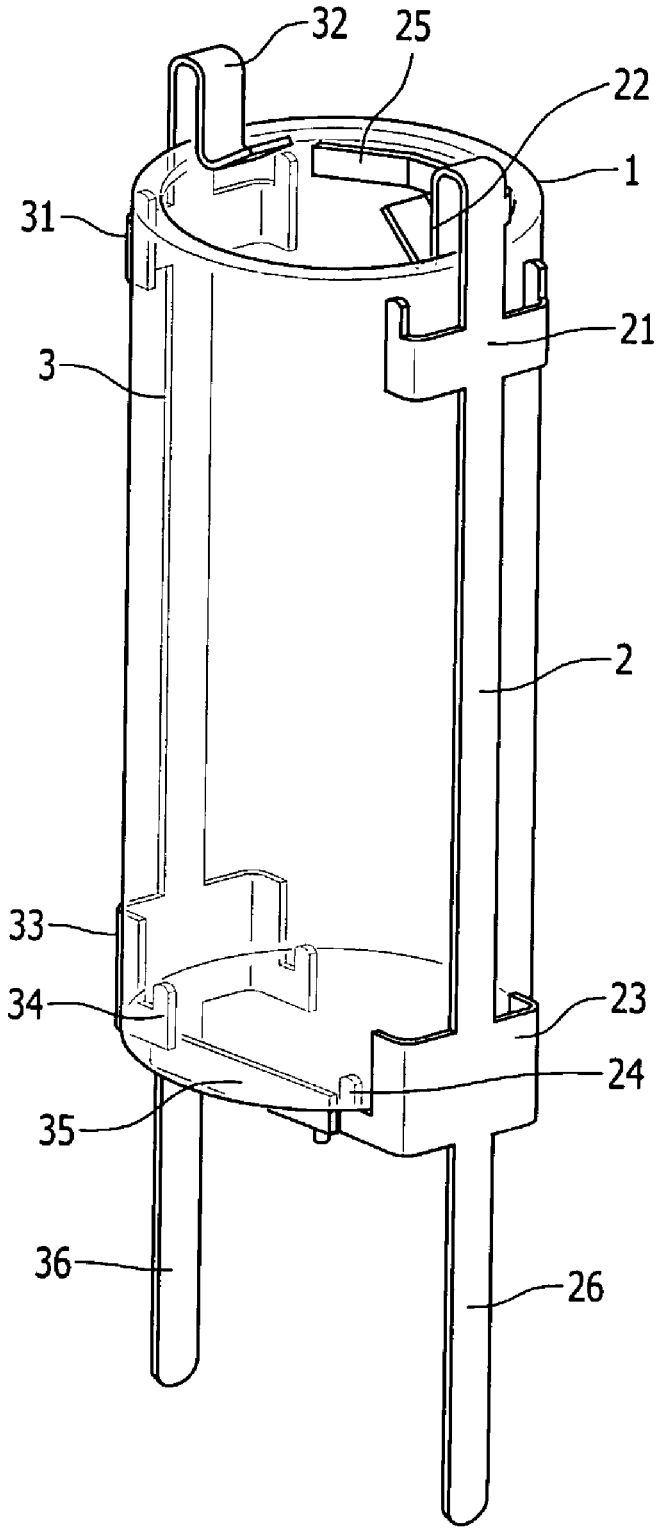
FIG. 1 is a perspective view of a sub-assembly according to the invention.

The sub-assembly shown in FIG. 1 comprises a quartz sleeve 1 and two frame members 2, 3. The frame members are individually supported by the sleeve, which is a strong and stiff isolator. The quartz sleeve has a typical wall thickness of 1.25 mm and a diameter of 19 mm. Each frame member comprises upper-end outer support means 21, 31 and upper-end inner support means 22, 32. The upper-end inner and outer support means 21, 22 and 31, 32 respectively, jointly form a clamping spring, by which each frame member is mounted to the sleeve. The distance between the two legs of the clamping spring is chosen to be such that, in the clamped position, the two legs slightly diverge, thus forcing the sleeve not only against the upper-end outer support, 21, 31 but also into the lower-end inner supports 24, 34, thus providing a vertical fixation of the sleeve. The lower-end inner and outer support means 24, 34 and 23, 33, respectively, form the connection with the lower end of the sleeve. The frame members comprise a finger 25, 35, respectively, for connecting a light source. Each frame member further comprises a support member 26, 36 for mounting in a lamp base.

Figure 2A:
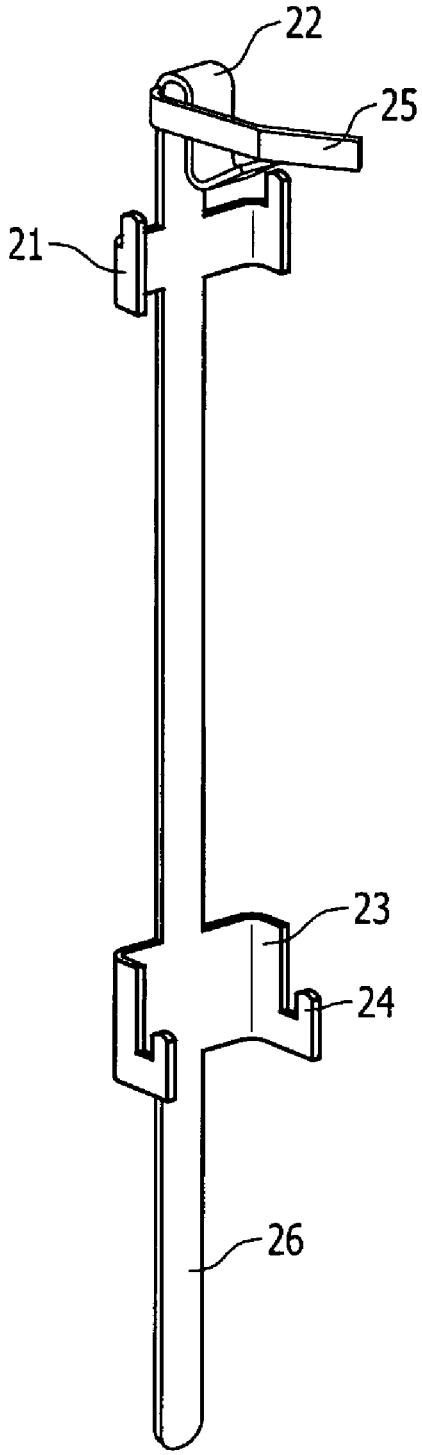
FIG. 2 is a perspective view of the frame member shown in FIG. 1.
Figure 2B:
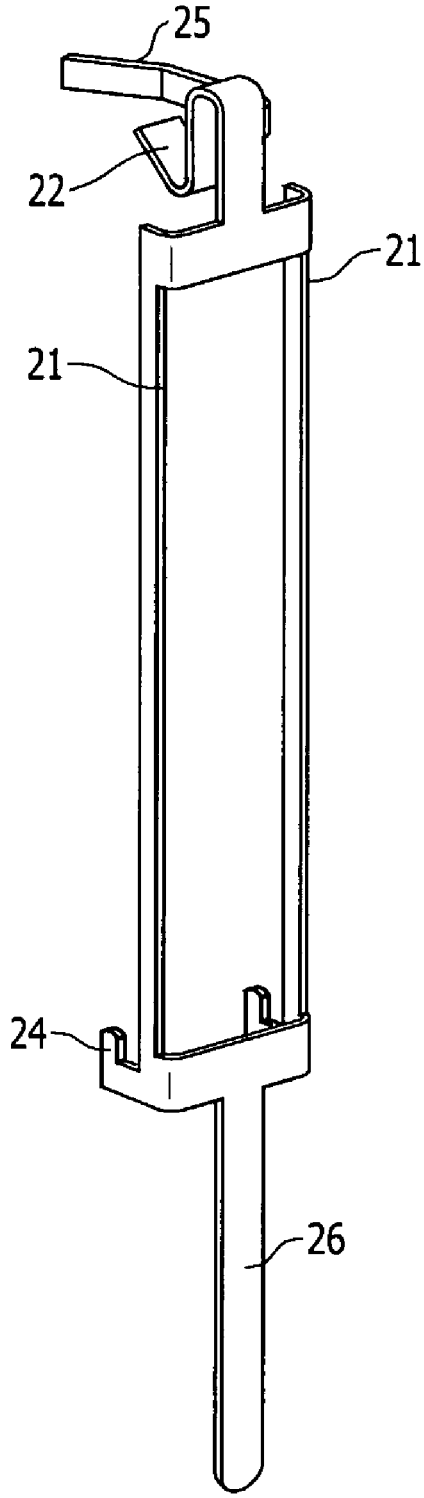
Figure 3:
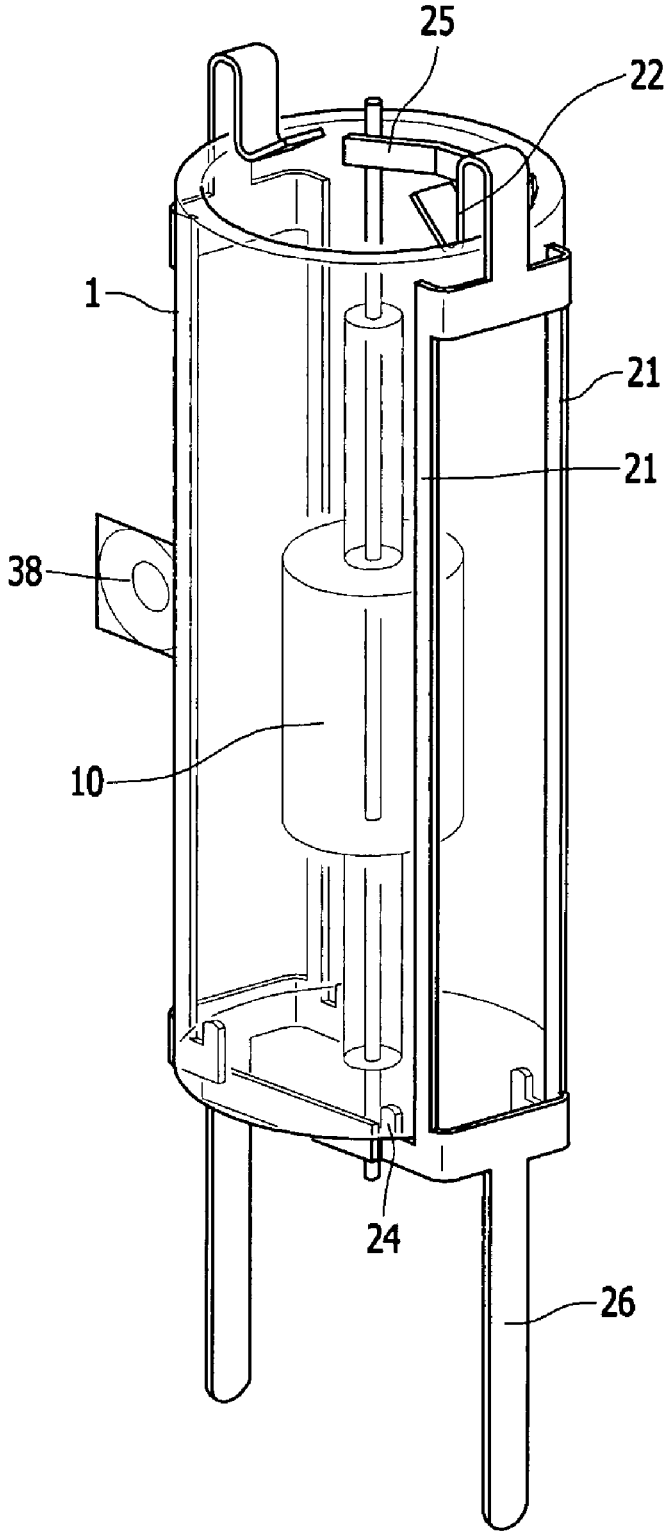
FIG. 3 is a perspective view of an alternative sub-assembly according to the invention, provided with a ceramic discharge vessel and a getter.

Details of an embodiment of a frame member are shown in FIG. 2A, wherein the respective parts are denoted by the same reference numerals as in the description of the sub-assembly above. In FIG. 2B, the upper and lower-end outer support means are combined in two outer support means 21 extending along the outer wall of the sleeve. A sub-assembly with the frame members of FIG. 2B is shown in FIG. 3. This sub-assembly further comprises a burner 10 and a getter 38.

Figure 4:
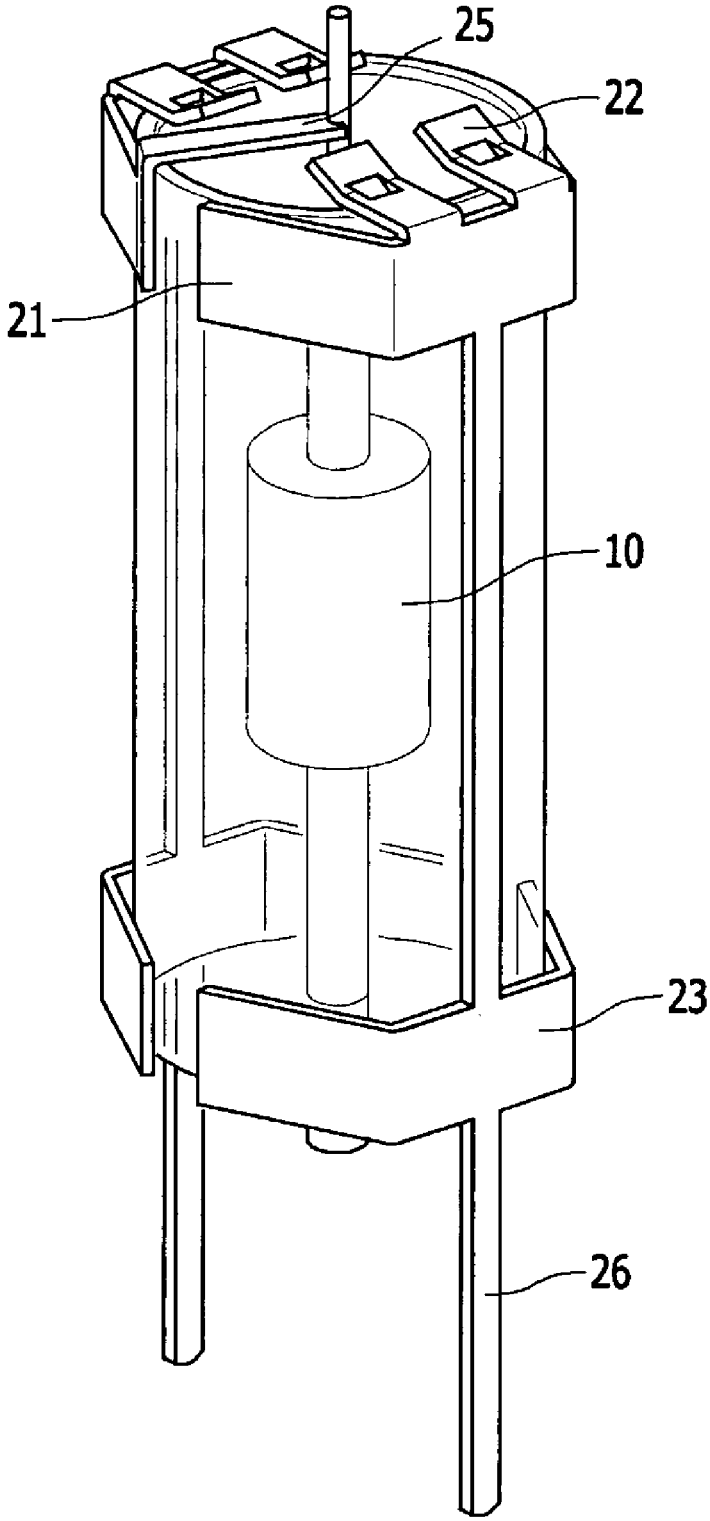
FIG. 4 is a perspective view of an alternative sub-assembly according to the invention, provided with a ceramic discharge vessel.

FIG. 4 shows another alternative sub-assembly with a burner 10. The main difference with the embodiment shown in FIG. 1 is the shape of the outer support means 21 and 23.

Figure 5:
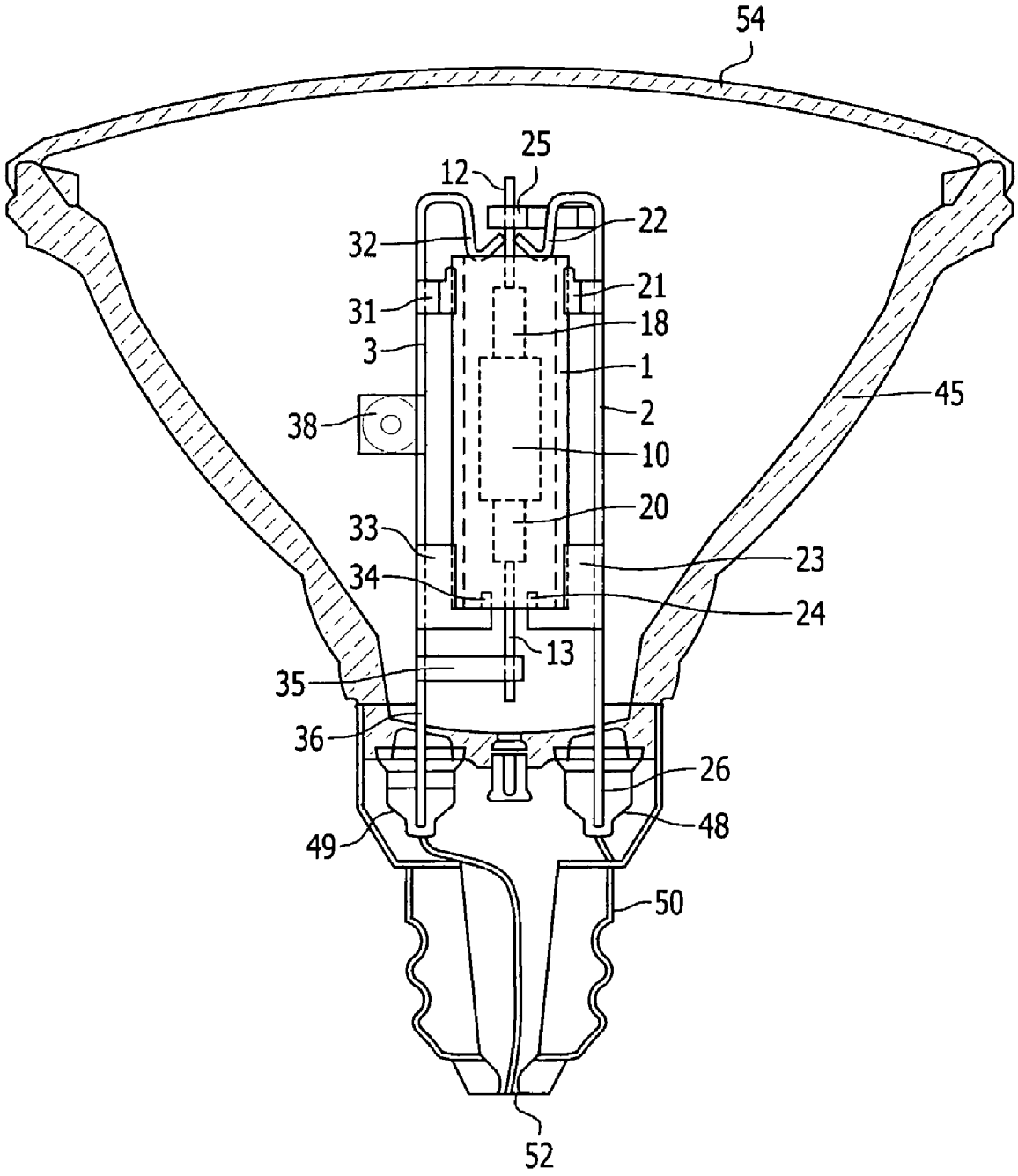
FIG. 5 is a schematic view of a PAR lamp comprising a sub-assembly according to the invention.

FIG. 5 is a schematic view of a PAR lamp comprising a sub-assembly according to the invention. The arc tube 10 has a cylindrical aluminum oxide envelope with a pair of opposite axial leads 12, 13 extending therefrom, and electrodes (not shown) for maintaining a discharge in the metal halide filling. The arc tube 10 having an upper end 18 and a lower end 20 is mounted between an upper finger 25 and a lower finger 35, both being part of respective frame members 2, 3, which are supported by a quartz sleeve 1. The frame members are preferably formed with stainless steel wire, but Mo, Nb, or Ni may also be used. The sub-assembly further comprises a getter 38.

Other parts of the lamp have a conventional design and include a glass envelope 45 with an aluminized inner surface (PAR), a pair of Ni/Fe ferrules 48 and 49 embedded in the glass, a brass base 50, a center contact 52, and a cover lens 54. The support members 26, 36 of the frame members 2, 3 fit into respective ferrules 48, 49, which in turn are electrically connected to the base 50 and center contact 52.

The lamp is manufactured by welding getter 38 to frame member 3, clamping the frame members 2, 3 onto the sleeve, and welding the arc tube 10 by its axial leads 12, 13 in between the fingers 25 and 35. The support members 26, 36 of the frame members 2, 3 are brazed into respective ferrules 48, 49. The cover 54 is then flame-sealed or glued in place, and a rugged lamp which withstands jarring is obtained.

It should be noted that the foregoing description of embodiments has been given by way of example and that it does not limit the scope of the appending claims.

The invention claimed is:

1. A lamp comprising:

(a) a light source;

(b) a cylindrical sleeve surrounding the light source having a sleeve upper end and a sleeve lower end, the cylindrical sleeve defining a central axis;

(c) first and second elongated frame members disposed about the sleeve, each elongated frame member comprising an upper end inner support member and an upper end outer support member which jointly form a clamping spring on the sleeve upper end, each elongated frame member further comprising a lower end inner support member and a lower end outer support member, wherein the clamping spring is arranged so that in the clamping position the sleeve upper end is clamped between the upper end outer support member and the upper end inner support member and the clamping spring applies force against the sleeve upper end to press the sleeve lower end into the lower end inner and outer support members, thereby fixing the position of each elongated frame member on the sleeve in the direction of the central axis, wherein the clamping spring fixes the position of each elongated frame member on the sleeve in a direction perpendicular to the direction of the central axis.

2. A lamp as claimed in claim 1, wherein the light source is a metal halide burner.

3. A lamp as claimed in claim 1, wherein the light source has a ceramic discharge vessel.

4. A lamp as claimed in claim 1, wherein the light source and the first and second elongated frame members are enclosed by an outer vessel which is a parabolic aluminized reflector.

5. A lamp according to claim 1, further comprising the upper end outer support member comprising a pair of legs.

6. A lamp according to claim 1, wherein the lower end inner and outer support members form at least one hooking shape.

7. A lamp according to claim 1, wherein at least one of the elongated frame members forms at least one integral finger for coupling with the light source.

8. A lamp according to claim 1, i. further comprising a base and ii. wherein a. each elongated frame member forms protrusions, the protrusions comprising:

(I) at least first and second pairs of integral symmetric legs, the first pair forming a hooking device on an end of the sleeve closer to the base, at least one of the second pair forming part of a clamping spring on an end of the sleeve farther from the base;

(II) at least one integral hooking shape at an end of the sleeve father from the base forming another part of the clamping spring; and (III) at least one integral extension for coupling with the base; and b. at least one frame member forms at least one integral finger extending inside the sleeve for coupling with the light source.

* * * * *